US007220154B2

(12) United States Patent
Lawson

(10) Patent No.: US 7,220,154 B2
(45) Date of Patent: May 22, 2007

(54) OUTBOARD JET DRIVE MARINE PROPULSION SYSTEM

(75) Inventor: William Lawson, Ormond Beach, FL (US)

(73) Assignee: Sword Marine Technology, Inc., Ormond Beach, FL (US)

( * ) Notice: Subject to any disclaimer, the term of this patent is extended or adjusted under 35 U.S.C. 154(b) by 0 days.

(21) Appl. No.: 10/988,327

(22) Filed: Nov. 12, 2004

(65) Prior Publication Data

US 2006/0046583 A1 Mar. 2, 2006

Related U.S. Application Data

(60) Provisional application No. 60/520,387, filed on Nov. 13, 2003.

(51) Int. Cl.
*B63H 11/04* (2006.01)
*B63H 11/11* (2006.01)
*B63H 21/38* (2006.01)

(52) U.S. Cl. ..... 440/38; 440/41; 440/88 D; 440/88 HE

(58) Field of Classification Search ..... 440/38, 440/40, 41, 42, 43, 46, 47
See application file for complete search history.

(56) References Cited

U.S. PATENT DOCUMENTS 3,105,353 A 10/1963 Schulz
3,212,258 A 10/1965 Gongwer
3,336,752 A 8/1967 Smith
3,809,005 A 5/1974 Rodler, Jr.
3,951,565 A 4/1976 Rothe et al.
4,073,257 A 2/1978 Rodler, Jr.
4,120,152 A 10/1978 Jackson, III
4,281,996 A 8/1981 Mouraret
4,437,841 A 3/1984 Stallman
4,457,724 A 7/1984 Miyamoto
4,538,996 A * 9/1985 Inwood ..... 440/38
4,722,708 A 2/1988 Baltz (Continued)

FOREIGN PATENT DOCUMENTS

DE 40 28 687 A1 * 3/1992

(Continued)

OTHER PUBLICATIONS

International Search Report, International Application No. PCT/US00/40604, mailed Jul. 2, 2001.

(Continued)

*Primary Examiner*—Sherman Basinger
(74) *Attorney, Agent, or Firm*—Howard M. Gitten; Edwards Angell Palmer & Dodge LLP

(57) ABSTRACT

An outboard jet drive marine system for a boat includes a housing, the housing has front and rear sides, and a top and bottom. The housing is adapted to be affixed behind a hull of a boat. An engine is disposed within the housing. A jet drive unit is releasably mounted to a housing extending from the rear of the housing and is operatively coupled to the engine in the housing. The jet drive unit includes a jet unit housing and drive shaft disposed within and supported by the jet unit housing. The jet unit housing is detachably received by the housing.

20 Claims, 15 Drawing Sheets

U.S. PATENT DOCUMENTS

| | | | | | |
|---|---|---|---|---|---|
| 4,792,282 | A | | 12/1988 | Jordan | |
| 4,820,215 | A | | 4/1989 | Mizusawa et al. | |
| 4,897,059 | A | | 1/1990 | Newman | |
| 4,964,821 | A | * | 10/1990 | Tafoya | 440/38 |
| 5,211,592 | A | | 5/1993 | Alkema | |
| 5,346,363 | A | | 9/1994 | Stallman et al. | |
| 5,356,319 | A | | 10/1994 | Parker | |
| 5,383,801 | A | | 1/1995 | Chas | |
| 5,435,763 | A | | 7/1995 | Pignata | |
| 5,460,552 | A | | 10/1995 | Blanchard et al. | |
| 5,536,187 | A | | 7/1996 | Nanami | |
| 5,567,188 | A | * | 10/1996 | Allebosch | 440/38 |
| 5,685,802 | A | | 11/1997 | Kanno | |
| 5,752,863 | A | | 5/1998 | Baker | |
| 5,769,674 | A | | 6/1998 | Stallman | |
| 5,913,294 | A | | 6/1999 | Takahashi et al. | |
| 5,938,490 | A | | 8/1999 | Rodler | |
| 6,004,173 | A | | 12/1999 | Schott | |
| 6,050,866 | A | | 4/2000 | Bass | |
| 6,059,618 | A | | 5/2000 | Purnell et al. | |
| 6,132,269 | A | | 10/2000 | Belt | |
| 6,149,478 | A | | 11/2000 | Lehmann | |
| 6,193,569 | B1 | | 2/2001 | Davies et al. | |
| 6,293,842 | B1 | | 9/2001 | Belt | |
| 6,361,387 | B1 | | 3/2002 | Clarkson | |
| 6,398,600 | B1 | | 6/2002 | Lawson | |
| 6,454,621 | B2 | * | 9/2002 | Matsuda | 440/88 R |
| 6,482,055 | B1 | | 11/2002 | Freitag | |
| 6,536,214 | B2 | | 3/2003 | Finger et al. | |
| 6,655,307 | B2 | | 12/2003 | Gokan | |
| 6,776,674 | B2 | * | 8/2004 | Blanchard | 440/38 |

FOREIGN PATENT DOCUMENTS

| | | |
|---|---|---|
| GB | 2 032 871 A | 5/1980 |

OTHER PUBLICATIONS

International Search Report and The Written Opinion of the International Searching Authority, dated Sep. 13, 2006.

* cited by examiner

OUTBOARD JET DRIVE MARINE PROPULSION SYSTEM

CROSS-REFERENCE TO RELATED APPLICATIONS

This Application is a Non-Provisional of Provisional (35 USC 119(e)) application 60/520,387 filed on Nov. 13, 2003.

BACKGROUND OF THE INVENTION

This invention relates to outboard jet drive marine propulsion systems. The present invention relates to an outboard jet drive for a boat and especially to an outboard jet drive having an engine and jet drive mounted in a housing, which is removably attached to a boat hull.

There have been several proposed types of outboard set drives for watercraft but most are similar to an outboard motor in which the outboard motor propeller and lower unit have been replaced with a jet drive. The jet drive includes a jet pump in the lower unit that operates to provide propulsion force for a watercraft. There are advantages in employing jet pumps for propulsion units as opposed to propellers. The jet drive permits operation in shallower water, also the propeller is shrouded, and there is less likelihood of injury. There has been a variety of proposed constructions for outboard jet drives for positioning the jet pump in different positions relative to the hull transom and bottom of the transom but in a typical jet drive, the engine and jet drive are located directly in the hull with an opening in the bottom of the hull for capturing water passing under the hull and then utilizing the jet pumps to thrust the water out the rear of the hull to propel the boat. Outboard jet drive units are made similar to typical outboard motors with a motor driving a drive unit, which operates a jet drive unit.

Generally, the engine package includes an internal combustion engine mounted in a thin fiberglass hull. The base plate of the hull includes a water inlet scoop for feeding water to the pump and an exhaust port for exhausting the water. The pumps high-pressure water outlet is pointed in the aft direction above the water line to propel the craft by the reaction force resulting from the high velocity water jet. In the F. C. Clark U.S. Pat. No. 3,055,175, a marine propulsion unit takes a conventional outboard motor and replaces the prop unit with a marine jet motor using a pump to issue a jet of water to propel a boat. The Parker U.S. Pat. No. 5,356,319, is for a boat with a removably inboard jet propulsion unit in which the integral jet power unit is encased in a waterproof housing and positioned in a well located in the hull and is mounted to be removed from the hull.

Many of the shortcomings of the prior art were overcome by Applicant's U.S. Pat. No. 6,398,600 in which an outboard jet propulsion unit is detachably mounted to a boat so that the main fuel tank and controls are mounted within the hull of a boat while the outboard jet drive unit is mounted away from the boat in a housing with an engine and is removably attached to the transom of the boat. The fuel tank and controls are connected between the hull and outboard drive through quick disconnect couplings. The housing is shaped to support an engine on a platform directly over the jet drive unit for actuating the jet drive unit through a clutch mechanism with the engine and jet drive positioned parallel to each other.

The outboard jet unit as designed by Applicant was satisfactory, however, it did not fully realize the efficiencies of jet propulsion. Accordingly, an outboard jet propulsion unit which overcomes the deficiencies of the prior art is desired.

BRIEF SUMMARY OF THE INVENTION

An outboard jet drive includes a housing sealed against the intrusion of water, the housing having front and rear sides and a top and bottom. An engine is disposed in the housing, supported generally horizontally within the housing, and a jet drive unit is disposed in said housing. The jet drive housing is shaped so that at least the bottom surface, when submerged in water, creates a high-pressure area along the bottom of the housing.

In a preferred embodiment, the jet drive unit includes an exhaust for exhausting a water jet. A bucket mechanism is mounted at the water exhaust, the bucket mechanism includes a housing disposed on said jet drive, which communicates with a water jet exiting said jet drive unit. The housing has a first exhaust and a second exhaust and a bucket member movably attached to the housing to selectively cause the water jet to either exit through the first exhaust or the second exhaust.

In yet another embodiment, the housing includes a heat exchange unit which is vertically disposed within the housing. The heat exchange unit allows automatic draining of water from the heat exchangers.

In yet another embodiment of the invention, a stabilizing structure is provided to support a jet drive unit internally of the housing to reduce excessive vibration of the jet unit thereby reducing wear and tear.

BRIEF DESCRIPTION OF THE DRAWINGS

Other objects, features, and advantages of the present invention will be apparent from the written description and the drawings in which.

DETAILED DESCRIPTION OF THE INVENTION

Figure 1:
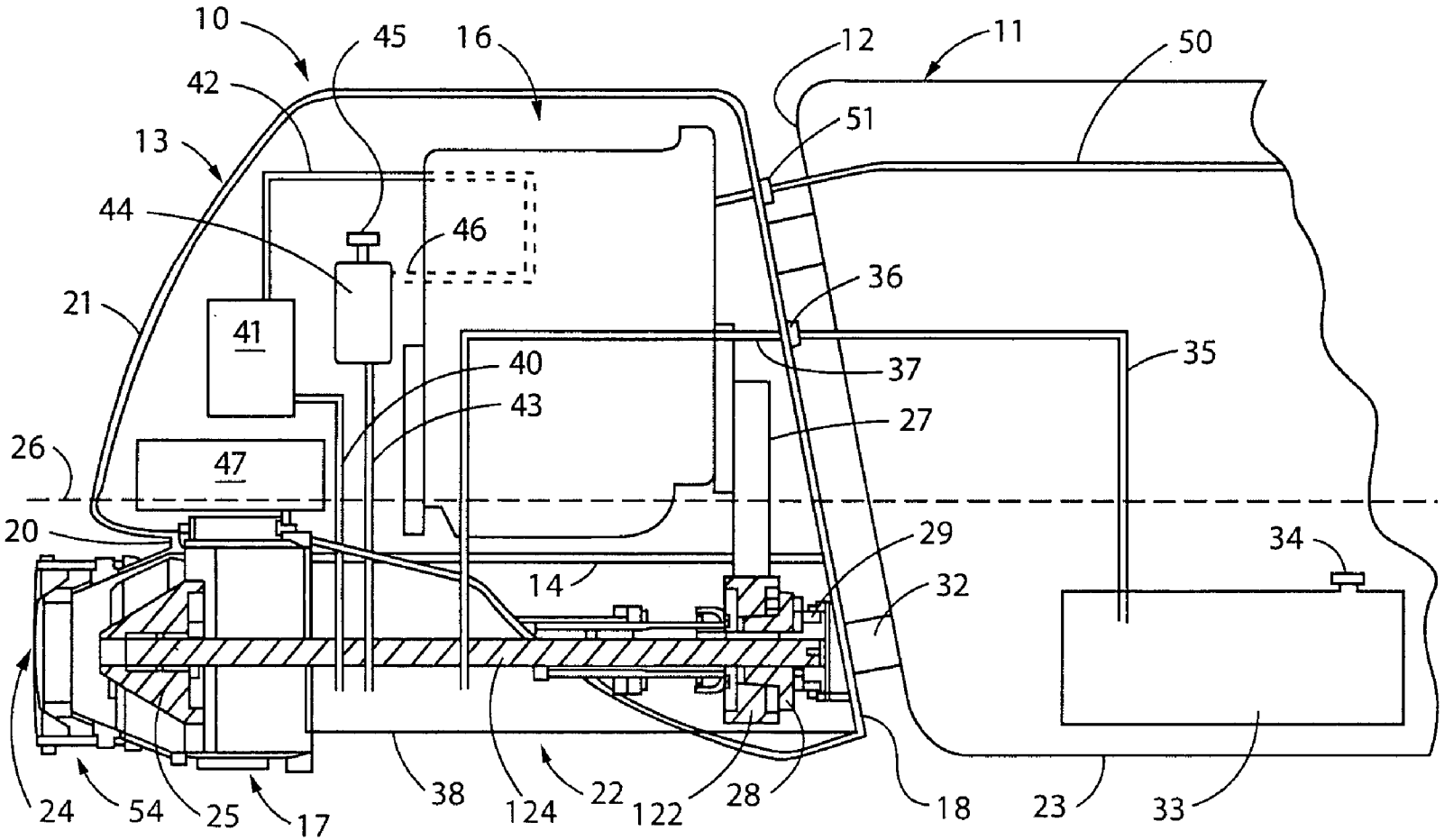
FIG. 1 is a sectional view taken through an outboard jet drive as mounted on a boat in accordance with the present invention.
Figure 2:
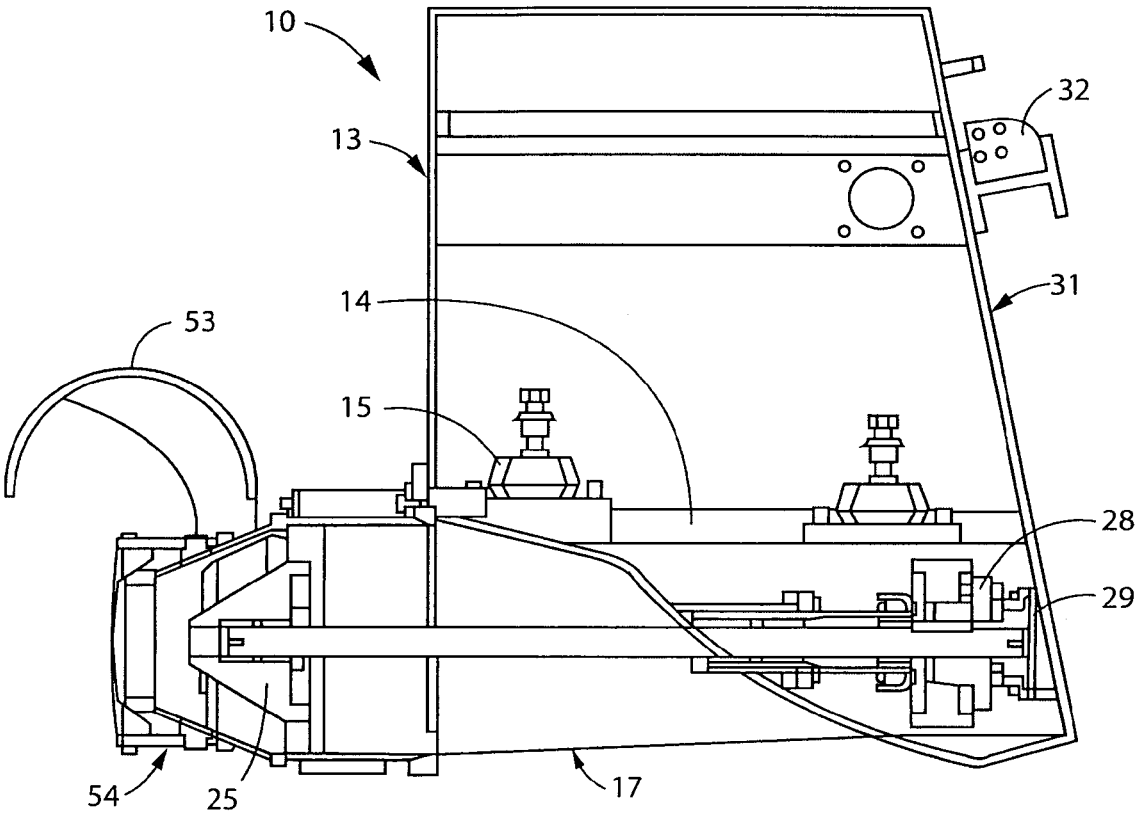
FIG. 2 is a sectional view of an outboard jet drive housing having a jet drive unit mounted therein.
Figure 3:
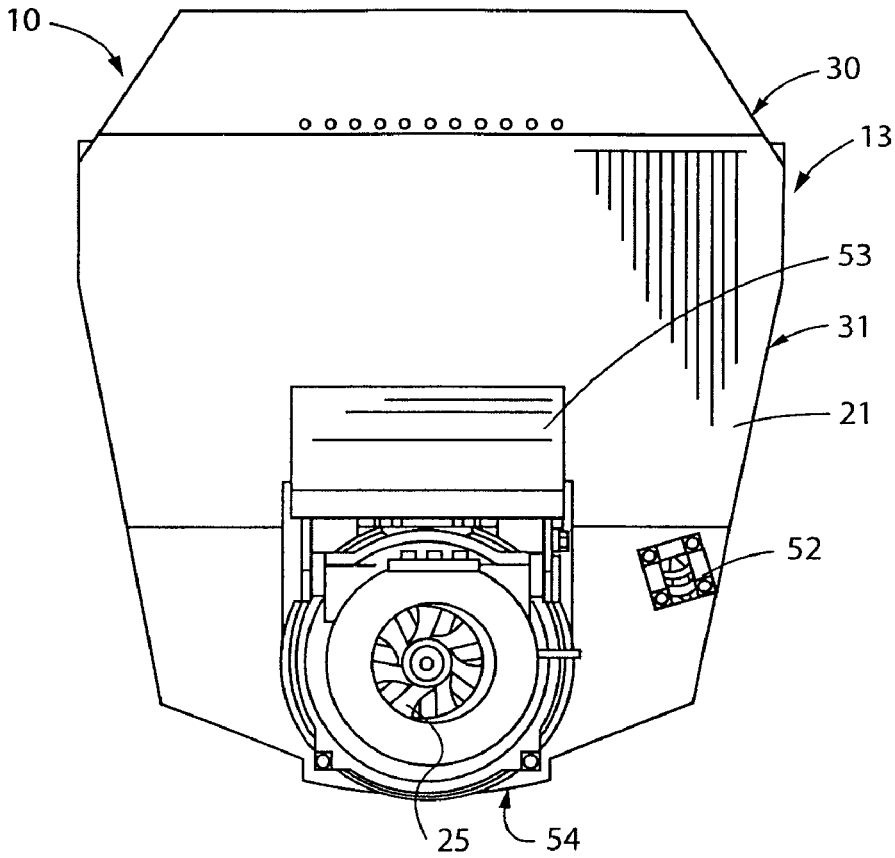
FIG. 3 is a rear elevation of the jet drive unit of FIG. 2.

Referring to FIGS. 1-3, an outboard jet drive unit 10 is shown attached to the hull of a boat 11 on the transom 12. The jet drive unit 17 includes a housing 13 having a platform 14 mounted therein and having a plurality of flexible engine mounts 15 attached to the platform 14. An internal combustion engine 16 is mounted to the engine mounts 15 on the platform 14. Engine 16 is preferably a diesel engine having a turbocharger with an intercooler, but may be a gasoline engine as well, and is preferably a conventional car or truck engine. A jet drive unit 17 is mounted beneath the platform 14 of the housing 13 and is attached to the front end 18 of housing 13. The housing 13 is sealed against the intrusion of water thereto and sealed between the platform 14 and the housing 13 to prevent water intrusion and to prevent oil or engine antifreeze from escaping therefrom.

The predominant prior art configuration of inboard jet boats is the inline setup, that is, the engine is connected in line with the jet drive; this has the engine's flywheel and drive pulley facing the transom (back of the boat) from inside the boat and the jet attached to it. By turning engine 16 and jet drive unit 17 around as compared to the prior art (i.e., 180 degrees) so that they are outside the boat behind the transom, as shown in the FIG. 1 in accordance with the present invention, the engine gear 120 and jet drive pulley 28 are positioned so that they both face in the same direction toward the transom from outside the boat, i.e., they face in the opposite direction of the inline arrangement. Thus, in this configuration, the drive pulley and engine flywheel are facing the back of the boat, but from outside the boat. Then, by using the drive belt system 27, the jet is placed substantially directly below the engine. It should be appreciated by those of skill in this field that by turning the engine around 180 degrees from the inline configuration, this will cause the impeller to turn in the opposite direction (backwards) from other impellers in use currently. Thus, the jet drive unit and engine are in essence installed "backwards" causing the impeller in the jet drive unit to rotate in the opposite or reverse or "backwards" direction, as compared to impellers in jet drive units configured inline.

Figure 5:
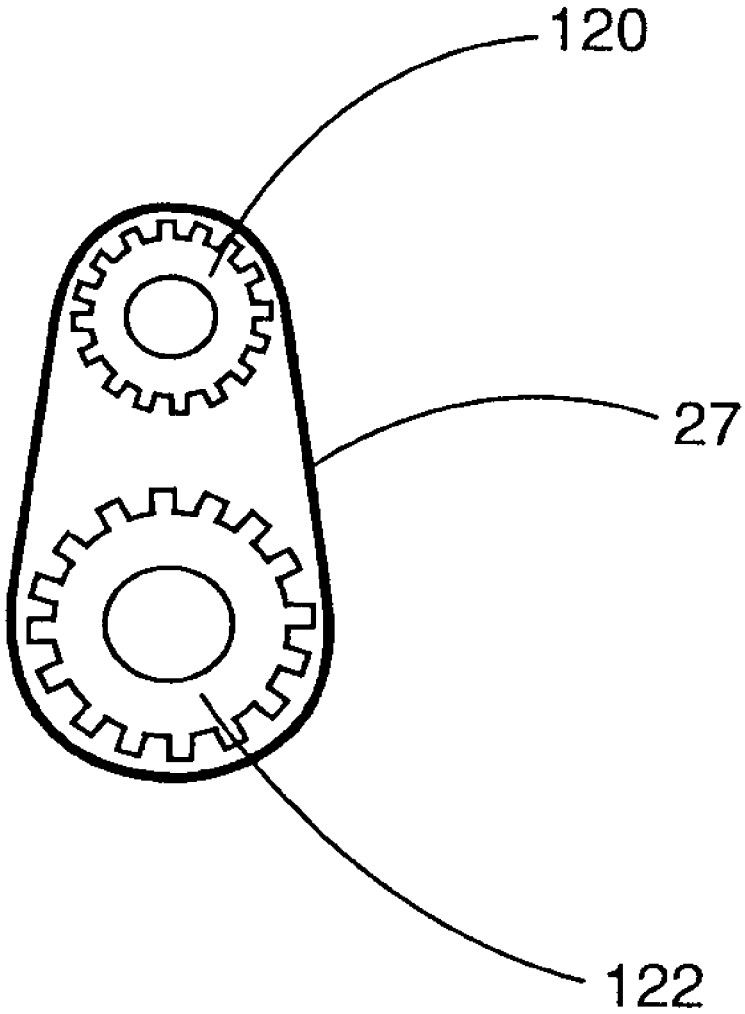
FIG. 5 is an elevation view of a drive assembly for an outboard jet drive constructed in accordance with the invention.
Figure 6:
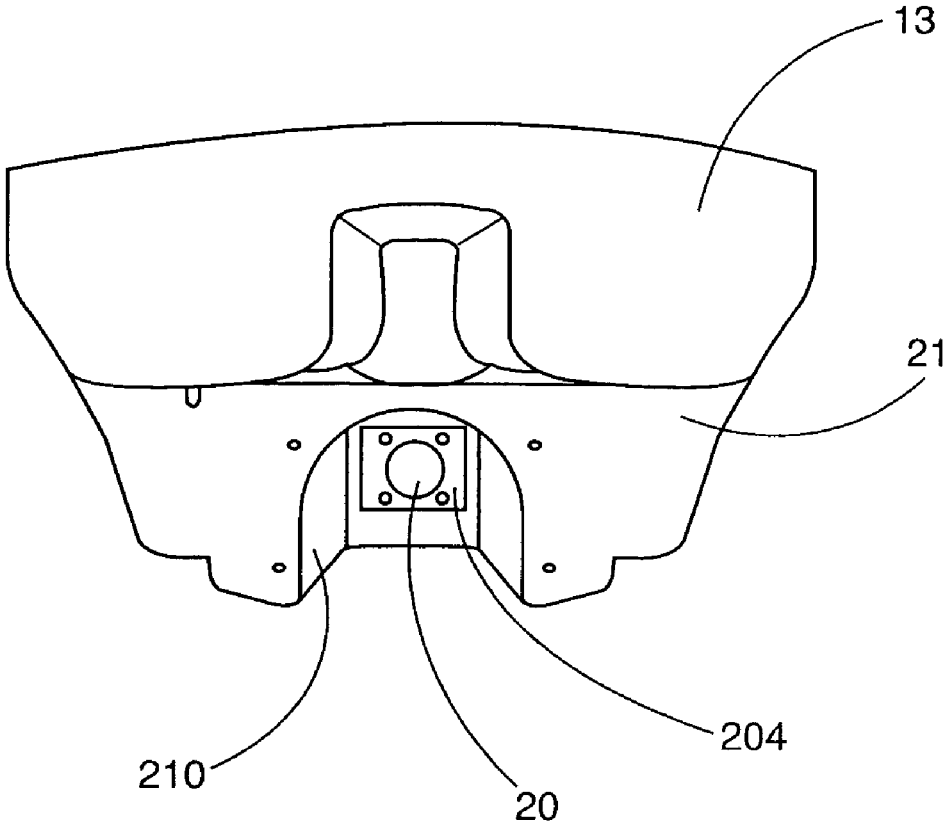
FIG. 6 a rear elevation view of an outboard jet drive housing constructed without the jet drive housing attached thereto.
Figure 8:
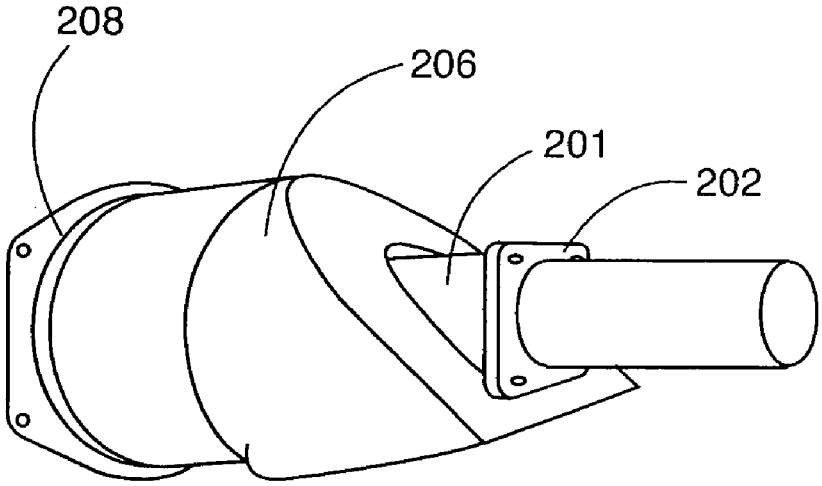
FIG. 8 is a perspective view of a jet drive housing constructed in accordance with the invention.

In an exemplary, non-limiting embodiment, engine 16 has a belt drive 27 having a clutch mechanism therein for connecting the engine 16 to the drive pulley 28 of the jet drive unit 17. More particularly, as shown in FIG. 5, a drive train is formed between a gear 120 on a flywheel of engine 16 connected on gear 122 (drive pulley 28) mounted on drive shaft 124 of jet drive shaft 17. In a preferred embodiment, belt drive 27 is a Kevlar® belt, preferably teethed to engage gears 120, 122 to prevent skipping and slippage.

While the parallel position is the most efficient and preferred position to for jet drive unit 17 and the internal combustion engine 16 system to be placed relative to each other, it is not the only possible position. In addition, by being positioned in parallel, it allows use of a standard horizontal engine and drive belt drive as illustrated in FIGS. 1, 2 and 5 and discussed above.

While it is preferred for jet drive unit 17 to be positioned below engine, other locations are contemplated by the present invention, such as on top, opposed, or on the side of the internal combustion engine.

Although acceptable within the scope of the invention, they are not preferable. By way of example, if jet drive unit 17 is positioned on top or above the engine, it will operate, however, it would require pumping water up to the jet. The higher the water is pumped, the more power is lost to pumping water and the larger the water intake needs to be (the water intake needs to gradually decrease in size throughout the water intake system, to avoid air bubbles from forming and causing cavitation).

Also, the best water flow for the jet intake is at the bottom center of the boat, which may create a problem diverting water around the engine. This position would also most likely cause the engine to be lower which creates another problem. That is corrosion and exhaust riser problems. The lowest part of a boat or marine engine compartment invariably gets water in it. Having the engine low puts the engine in the water.

If the jet drive unit 17 is positioned on one or both sides of engine 16, while this positioning is believed to be better positioning than on top, it still has the problems mentioned above, and would require much greater width of the finished unit, it may create a weight distribution problem in that engine 16 is much heavier than jet drive unit 17, especially if only one jet drive unit is employed. In addition, putting too much weight to one side or the other would most likely create handling problems with the boat.

As already indicated, when the jet drive unit is placed on the bottom or underneath the engine, this positioning is by far the most practical and preferred placement. The engine is elevated, reducing problems from corrosion and riser problems. The jet is at the lowest possible position, creating the best water flow into the jet intake. The weight is centered. Further, by putting the, weight of the engine directly over the jet drive unit and the water intake, the water intake is less likely to come out of the water as often happens in the current systems. When the water intake comes out of the water, both power and maneuverability are lost in a jet drive unit.

It is also preferential for the water path entering and exiting the jet drive unit to be axial or straight, as opposed to, for example, a circular or bent.

Furthermore, it should be understood that the engine could be attached with a chain, or possible with a direct drive system with a series of two or more gears, although the belt is preferable. A clutch may be used but is not required.

The advantage of the belt drive system is efficiency. The belt drive in theory transfers 98% of the engines power to the jet impeller. Other systems in practice lose approximately 15% of the engines power by the time power is transferred to the propeller or jet impeller.

Also, it is believed that this is the most cost effective method for a jet. For the jet to operate at its best efficiency, the jet should be sized appropriately to the horsepower and expected load. Most jet boats in operation today are using jets sized too small for optimum efficiency. This is done because the jet is being run at engine speed. Smaller jets can run at higher speeds (rotations per minute or "RPM"), larger jets must operate at lower speeds (RPM). In order for the jet to operate at a lower RPM than the engine, some sort of gearing reduction is required. Currently, when a reduction is put in place it is done with a transmission. With the belt drive system of the present invention, it is able to operate the jet at a lower RPM by using different sized gears and the gear size is preferably matched to the engine and jet size when installed.

Jet drive unit 17 extends through the rear 21 of housing 13 out an opening 20 in the housing 13. The jet drive unit 17 has a water intake 22 and is positioned to be about level with the bottom 23 of the hull 11. A water exhaust 24, providing the exit path for jetted water, extends out the rear of the housing 13. A jet pump 25 is mounted in the jet drive 17 for drawing the water thereinto through the jet pump and out the water exhaust 24. The jet drive unit 17 is shown below the water line 26 and is supported on brackets 29 on the front 18 of the housing 13.

Reference is now made to FIG. 6-9 in which a mounting structure in accordance with the preferred embodiment for the drive jet unit 17 is provided. As discussed above, jet drive unit 17 is mounted to housing 13 in a way to operatively cooperate with engine 16. Housing 13 is provided at its rear face 21 with an opening 20. Opening 20 communicates with the interior of housing 13.

Jet drive unit 17 may be formed as a removable cartridge. In a preferred embodiment, jet drive unit 17 is housed in a removable jet housing 206. Jet housing 206 supports a drive shaft housing 201 in which drive shaft 124 is disposed. Drive shaft housing 201 is received in opening 20 and extends through opening 20 and forms a watertight seal with housing 13. In a preferred embodiment, housing 201 is bolted using a bolting plate 202 to a mating bolting plate 204 of housing 13. Gaskets and seals, as known in the art, are utilized to affix housing unit 201 to housing 13 in a watertight manner.

Jet unit 17 is formed as a unit about drive shaft 124. Therefore, drive shaft 124, mounted within housing unit 201, can be easily mounted to housing 13 by simply sliding the entire unit including housing 201 through opening 20. Drive pulley 28 is affixed to drive shaft 124, which in turn is attached to drive belt 27, and the entire jet propulsion unit is affixed to engine housing 13. As a result, simple assembly is provided while maintaining a separation between the engine structure, which remains away from water to prevent corrosion and the jet unit structure, which must come in contact with water.

In one embodiment, drive shaft housing 201 is slidably received within jet unit housing 206. Jet unit housing 206 is mounted to the rear surface 21 of housing 13 by bolting the housing in the rear. To maintain the overall shape of the outboard propulsion system 10, engine housing 13 may be formed with a recess 210 for receiving jet unit housing 206. Housing 206 is provided with a plate 208 for attachment to housing 13.

Figure 9:
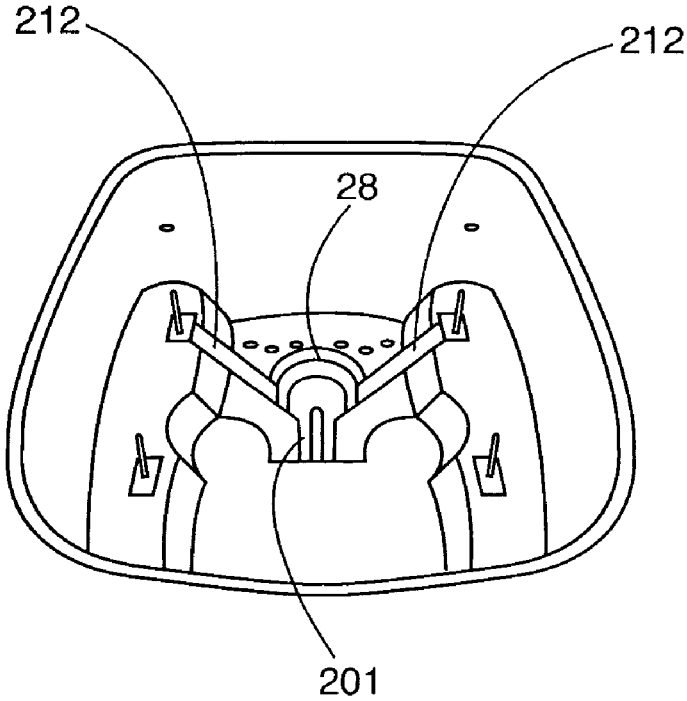
FIG. 9 is a perspective view of a drive shaft support assembly mounted within said housing in accordance with the invention.
Figure 7:
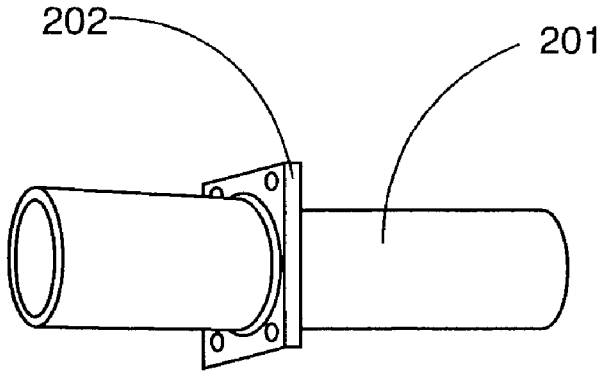
FIG. 7 is a drive shaft housing constructed in accordance with the invention.

Vibration along drive shaft 124 results in wear and tear on the drive shaft. This is especially true at each of the ends of the drive shaft 124. As seen in FIG. 9, brackets 212 affix drive shaft housing 201 to the interior of housing 13 at an end of drive shaft 124 adjacent drive pulley 28. A bracket 212 is provided at either side of drive shaft housing 201 to stabilize drive shaft 124 at its end.

In an exemplary embodiment, the brackets can be made from milled steel, aluminum, stainless steel or other materials. Stainless steel provides the best combination of stiffness, corrosion resistance and weight for the marine environment. In the preferred embodiment, brackets 212 need to be attached as close to the end of drive shaft 124 as possible to provide the best support although it is understood and within the scope of the invention, that brackets 212 could be attached to various positions in the engine compartment. Attaching brackets 124 above and on each side of drive shaft 124 provides the best support while keeping the brackets accessible for maintenance and keeping the fittings, bolt holes, bolts and the like as high above the bilge area as possible.

By placing bracket 202 substantially midway along the length of drive shaft housing 201, further support of drive shaft 124 is provided. When attached, flange 202 is disposed between housing 13 and jet unit housing 206, and is firmly attached to both, further supporting drive shaft 124 along its length. As discussed above, shaft housing 201 slides into the engine housing 13 as well as the jet housing 206. The three components are attached at flange 202 by welding, bolting or other known means and bolt plate 208 of jet housing 206 is bolted to rear surface 21 of housing 13. In this way, jet housing 206 is received and positioned within a receiving area 210 on the rear surface 21 of housing 13.

In a preferred embodiment, having flanges close to the middle of the drive shaft housing provides the best support. Other supports at the end of the drive shaft are helpful, but not required. A support system can be made from milled steel, aluminum, stainless steel or other materials. Again, stainless steel provides the best combination of stiffness, corrosion resistance and weight for the marine environment.

Outboard propulsion unit 10 utilizes a closed loop cooling system similar to those used in an automobile. In a preferred embodiment, propulsion unit 10 uses a water-to-water heat exchanger to cool engine 16 in a similar fashion to a radiator in an automobile. The water that circulates through the engine, the water-cooled exhaust manifold, and the oil cooler (where applicable) is treated with fresh water just like used in an automobile. However, propulsion unit 10 cannot expose the engine interior to seawater or dirty fresh water it utilizes during operation. Rather, the hot engine water is circulated by the engine water pump through a heat exchanger where it is cooled by the circulating seawater. Sea water is pumped through the heat exchanger by the water jet eliminating the requirement for a separate engine driven sea water pump and eliminating the high maintenance rubber sea water pump impeller.

In another advantage, the propulsion unit 10 may be equipped with turbochargers. The marine propulsion unit 10 also includes a stainless steel and cupronickel intercooler to cool the compressed air before it is inserted into the engine's intake manifold. The process of compressing the inlet air with the turbocharger increases the temperature of the air. Cooling the inlet air with seawater in the intercooler enables the engine to produce more power more economically and reduces the smoke and other pollution from the engine exhaust to meet environmental standards.

In another advantage, the marine propulsion unit 10 may be equipped with fuel coolers. It is believed that fuel injected engines deliver more fuel to the engine than the engine requires. The excess fuel is returned to the fuel tank for use later. The returned fuel is heated by the engine and tends to raise the temperature of the fuel in the tank over a period of time. The higher fuel temperature reduces the engine power and performance. The fuel cooler eliminates this problem. The fuel cooler is constructed of stainless steel and cupronickel and uses seawater for cooling.

Figure 24:
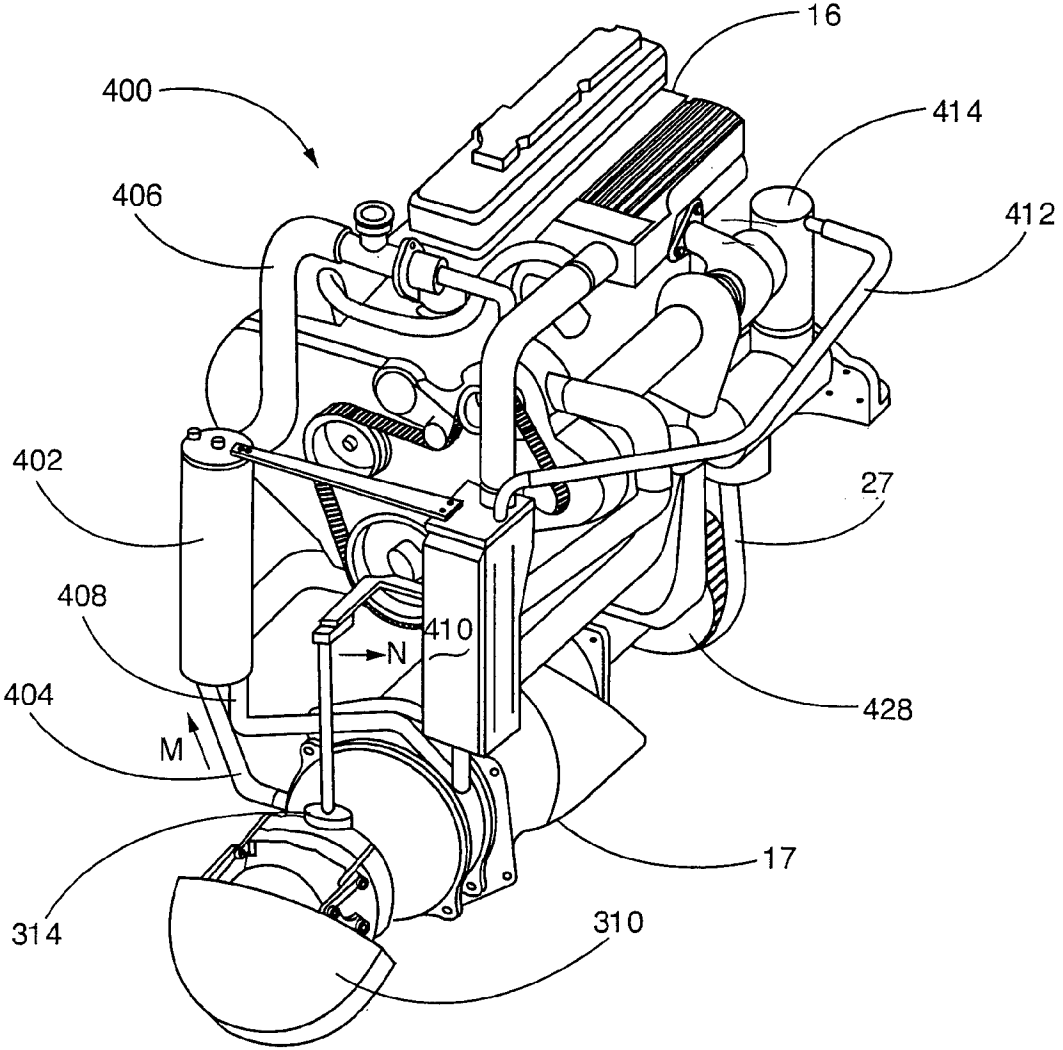
FIG. 24 is a perspective view of an outboard jet propulsion unit constructed in accordance with another embodiment of the invention.

Reference is now made to FIG. 24 in which yet another embodiment of outboard propulsion unit 10 utilizing a cooling system is provided. Like numerals are used to indicate like structure for ease of description. Propulsion unit 400 includes an engine 16 and a jet unit 17. A heat exchanger 402 is coupled to jet unit 17 by hosing 404. Heat exchanger 402 is also coupled to engine 16 by hosing 406. A second hosing 408 couples heat exchanger 402 to an intercooler 410. Intercooler 410 is connected by hosing 412 to an exhaust 414 of engine 16. Furthermore, intercooler 410 is coupled to the fuel line of engine 16 and the turbo charger of engine 16.

During operation, hosing 404 is coupled to the jet unit 17 and siphons a portion of the jet stream as it travels through jet unit 17 so that water under pressure travels in the direction of arrow M into heat exchanger 402. Hose 406 communicates with piping (not shown, but known in the art) within heat exchanger 402 which is surrounded by the cool water flowing from hosing 404 into heat exchanger 402. In this way, engine 16 is isolated from the water passing through jet unit 17. The pressure provided by the jet stream and gravity cause heated water to exit heat exchanger 402 through hose 408 in the direction of arrow N into intercooler 410. Intercooler 410 includes piping systems, which communicate with the turbo charger, exhaust 414, and fuel line of engine 16 cooling the air and fuel within the engine to provide greater efficiency for a turbo charged engine.

It should be noted that heat exchanger 402 and intercooler 410 are each preferably oriented vertically relative to the horizontal orientation of engine 16. In this way, if in fact outboard propulsion system 10 is not running, gravity drains the seawater or clear water from heat exchanger 402 into hose 408 or back into hose 404. In this way, no seawater remains in the heat exchanger 402 longer than necessary, reducing the corrosion to any piping within heat exchanger 402 or structure within intercooler 410. Furthermore, heat exchanger 402 is preferably made of stainless steel and cupronickel, both highly corrosion-resistant alloys to help ensure that the interior of engine 16 is never exposed to seawater. Additionally, no engine flushing is required after each boat trip because a closed cooling system is provided, engine 16 should experience a longer and more reliable life.

Figure 10:
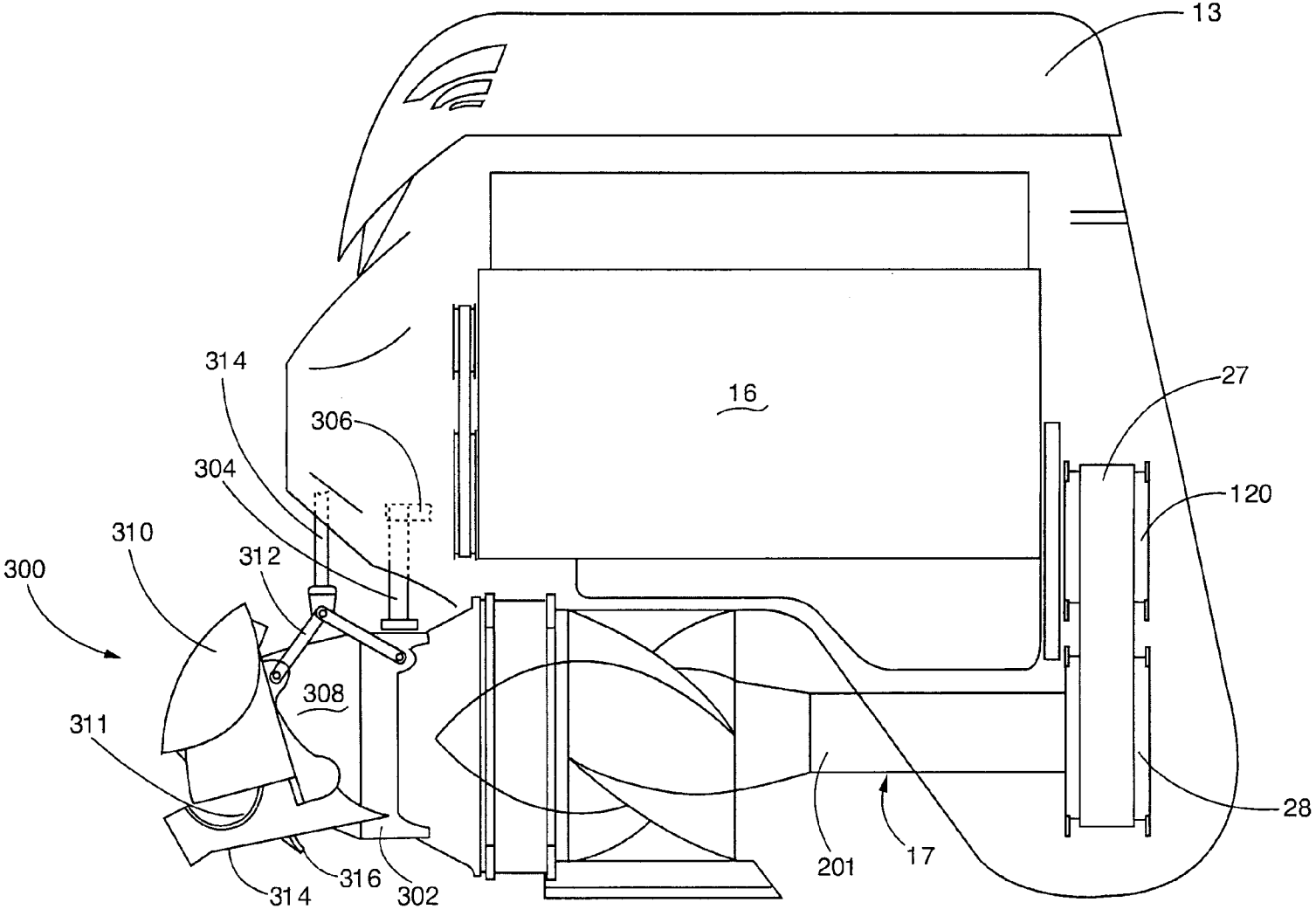
FIG. 10 is a side elevation view of another embodiment of the invention in which a bucket assembly is mounted on the jet drive unit in accordance with the invention.
Figure 11:
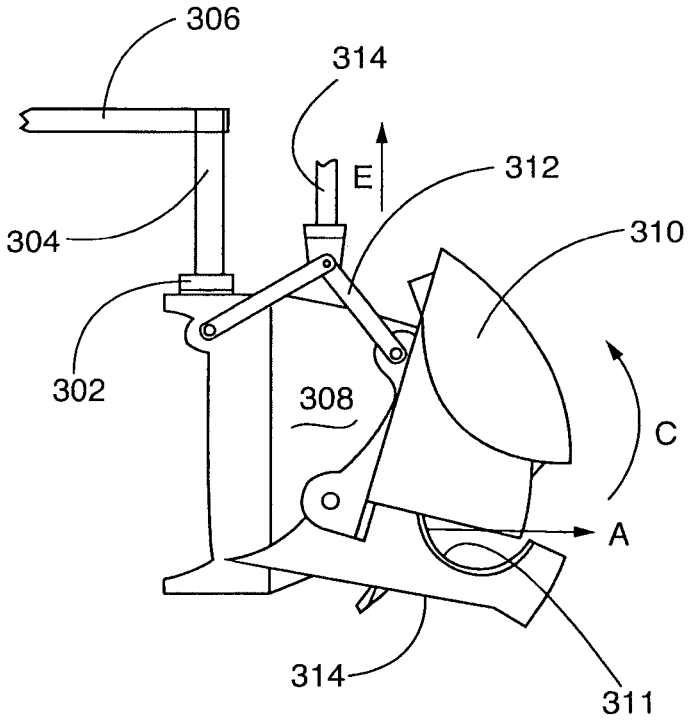
FIG. 11 is a side elevation view of the bucket assembly in the open position.
Figure 12:
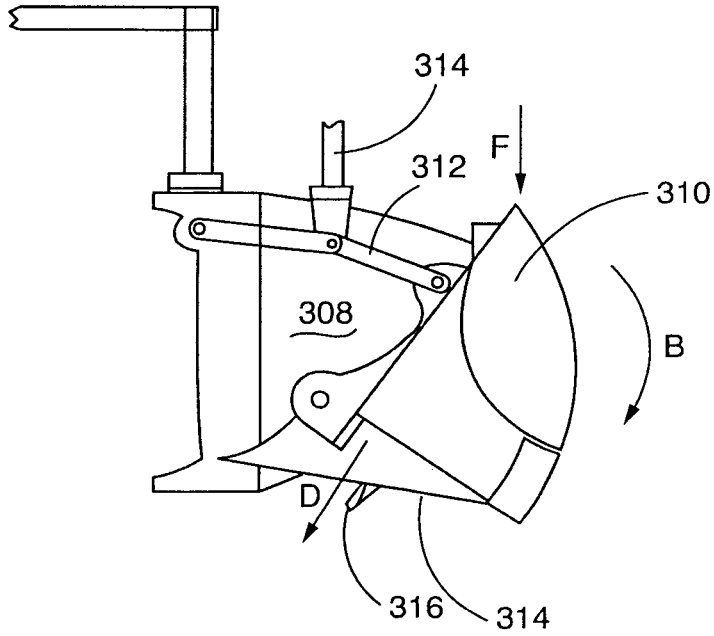
FIG. 12 is a side elevation view of the bucket assembly in the closed position.
Figure 13:
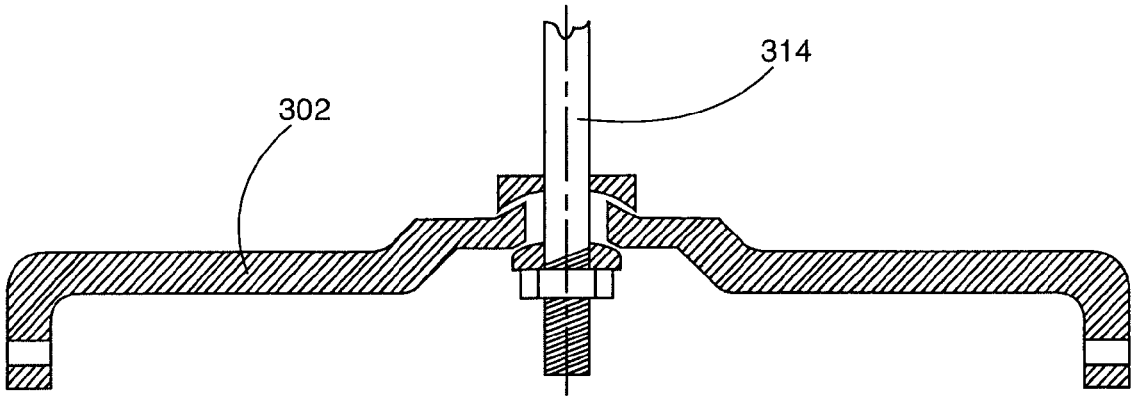
FIG. 13 is a sectional view of a saddle assembly for supporting the bucket assembly.
Figure 14:
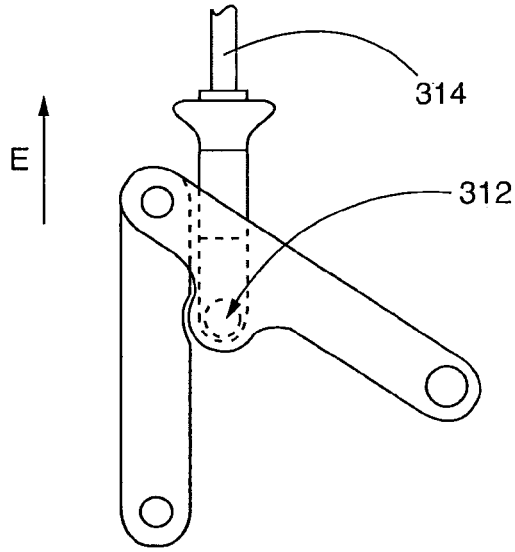
FIG. 14 is a side elevation view of a control assembly for the bucket in the open position.
Figure 15:
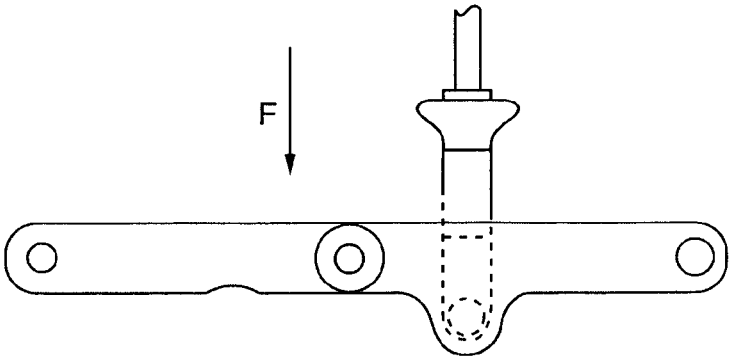
FIG. 15 is a side elevation view of a control assembly for the bucket in the closed position.

Reference is now made to FIGS. 10-18 in which another embodiment of the jet engine is provided. Like numerals are utilized to identify like structure for ease of description. Water exiting jet exit portion 54 (FIG. 1) is what provides the driving force for the outboard jet propulsion engine, and in turn, the boat to which it is attached. Because exhaust portion 54 is fixed to the fixed structure of housing 13 as described above, a mechanism is required to allow reverse operation and steering. As shown in FIG. 10, a bucket assembly, generally indicated as 300, is attached to jet drive unit 17 at exit portion 54 so that water exiting water exhaust 24 is operated upon by bucket assembly 300.

Bucket assembly 300 includes a bucket housing 308. Bucket housing 308 is supported by a saddle 302 suspended from housing 13 by a suspension arm 35. Suspension arm 35 is operatively linked to a steering rod 306. It is understood and within the scope of the invention that any structure for supporting bucket housing 308 may be used so long as bucket housing 308 is supported at water exhaust 24 so as to receive water existing water exhaust 24. Bucket housing 308 has an entrance port 309 for receiving water exiting water exhaust 24 and a first exhaust 311 and second exhaust 314 for causing water to exist housing 308.

A bucket 310 is pivotably mounted on housing 308. A bucket linkage 312 is connected to bucket 310 and a reverse cable 314, which controls linkage 312 to rotate bucket 310 in the direction of arrow C to a first position in which bucket 310 is open to allow water to pass through exhaust 311 in the direction of arrow A. Linkage 312 also controls bucket 310 to move in the direction of arrow B to close first exhaust 311 (FIG. 12) and redirect the water path through second exhaust 314 of housing 308. A directional member 316 is provided at exhaust 314 to guide the water in a direction substantially in the direction of arrow D back towards housing 13.

It should be noted that a pivoting bucket shaped member is utilized, but any structure which selectively opens and closes water exhaust 311 may be utilized. In a preferred embodiment, by way of example only, linkage mechanism 312 is a bi-armed structure having a pivot, connecting one arm to the other at a position linked to reverse cable 314 such that movement of reverse cable 314 in the direction of arrow E (FIG. 13) lifts the pivot point of member 312 bringing the two arms together (FIG. 14) shortening the distance, drawing bucket 310 toward saddle 302 and lifting bucket 310 in the direction of arrow C. In this way, water is allowed to pass substantially unimpeded in the direction of arrow A, pushing housing 13 and the boat affixed thereto in the forward direction. However, any control structure for moving bucket 310 may be used.

When reverse cable 314 moves in the direction of arrow F (FIG. 12), the arms of member 12 are spread (FIG. 15) rotating bucket 310 in the direction of arrow B closing one end of housing 308 and forcing water to exit in the direction of arrow D back towards the boat. The force of water exiting through opening 314 as guided by guide member 316, pushes the boat in a reverse direction. Reverse cable 314 is coupled to the controls of the boat by either mechanical or electro controls.

In a preferred embodiment, the reverse cable is mounted on a steering nozzle. This gives maximum reverse thrust control with a steering nozzle mounted to maintain normal reversing direction with a reverse bucket using a standard 3-inch stroke cable. In order to keep the cable out of the water, the vertical operation was designed, i.e., the cable structure is mounted to cooperate with housing 308 above jet pack unit 17 substantially away from the water. This keeps the entire cable, except for the stainless push/pull rod of member 312 over the normal water line eliminating the need for boots, seals or rust-proofing. In order to keep the reverse bucket from moving up and down excessively during steering, reverse cable 314 is positioned close to the rotational point of the steering, i.e. near the steering cable 304, 306 at steering rod.

In a preferred embodiment, the reverse bucket, levers, bearings and bolts are made of stainless steel and could be made of any suitable material such as aluminum, fiberglass, plastic or any rigid material. The stroke of cable 314 is preferably limited to about 3 inches and is to be hand-powered and moved in a maximum amount of reverse direction with a minimum effort which is achieved by putting an additional stationary diverter, or the like, below the exhaust that the reverse bucket comes down to meet in the full reverse position, that, when connected, adds additional reverse rotation to the bucket. The end of cable 314 has a swivel (ball-type) at the saddle 302 to allow the cable to stay stationary while steering is being turned and also allows angle changes on any steering or reverse bucket position. The arms of member 12 provided at the boat are designed to lock in the forward position and in reverse, eliminating kickback on the cable and allowing the use of full thrust in reverse gear without relying on the cable to hold the bucket in place.

By utilizing an outboard motor, so that exhaust portion 54 of jet drive unit 17 is distanced away from hull 12 of boat 11, the water jet exiting housing 308 through exhaust opening 314 does not substantially interact with hull 11. As a result, the hull does not substantially interfere with the exiting jet stream and the efficiency of, the jet engine when driving in reverse is greatly increased.

Figure 16:
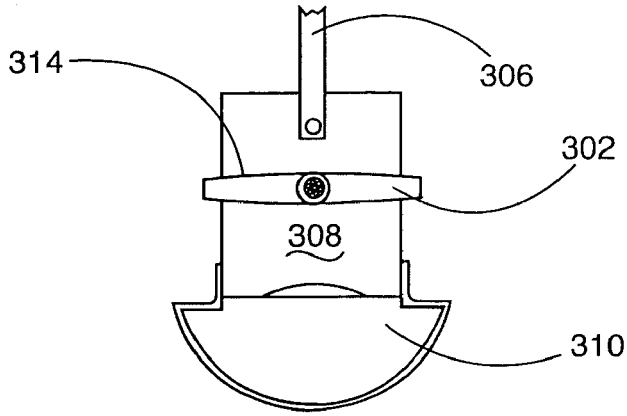
FIG. 16 is a top plan view of the bucket assembly.
Figure 17:
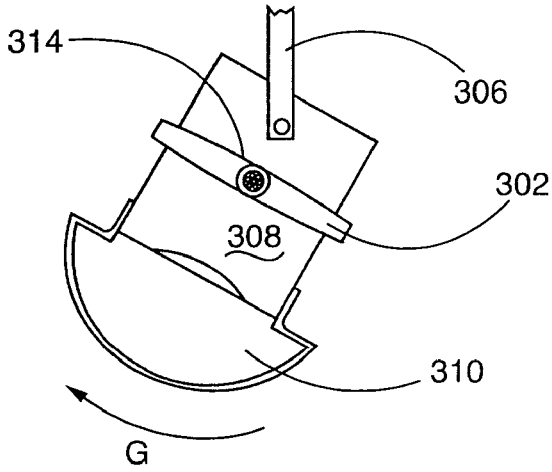
FIG. 17 is a top plan view of a bucket assembly steering a boat to the left.
Figure 18:
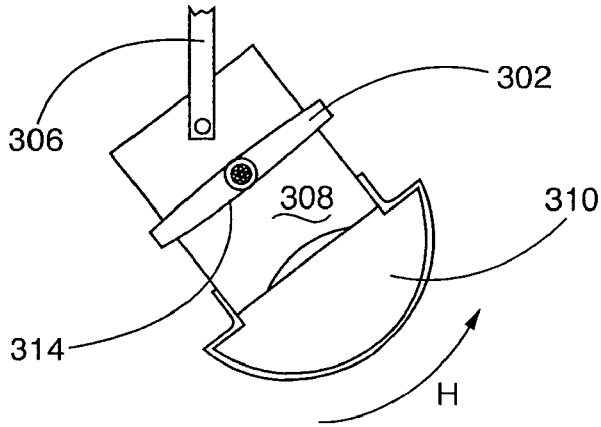
FIG. 18 is a top plan view of a bucket assembly steering a boat to the right.
Figure 19:
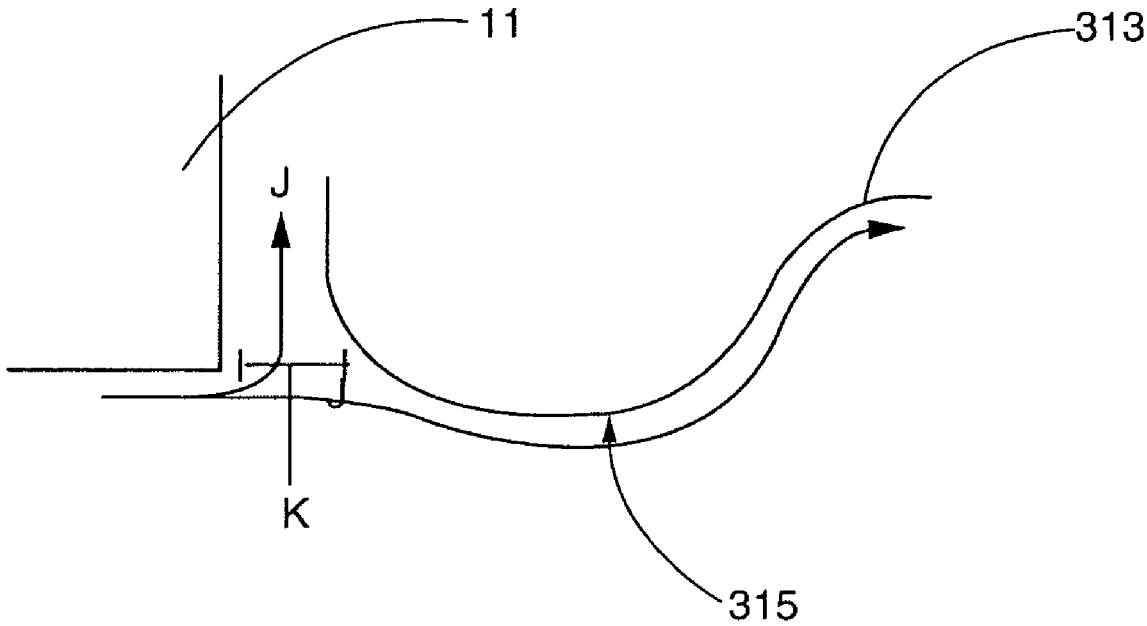
FIG. 19 is a schematic view of the bottom of the housing showing relative water and airflow.

Reference is now made to FIGS. 16-18. Steering rod 306 is pivotably connected to bucket housing 308. Steering rod 306 is also coupled to hand controls on boat 11 so that a driver may control steering. Through movement of steering rod 306, bucket assembly 308 is rotated in the direction of arrow G to produce a left turn or in the direction of arrow H to produce a right turn.

Top 30 of housing 13 is removable from the housing main part 31, as shown in FIG. 3. The housing 13 with the engine 16 and the jet drive unit 17 mounted therein may be attached to the transom 12 of the hull 11 with a pair of brackets 32. Brackets 32 allow the housing 13 to be mounted substantially even with the bottom of the boat hull or higher than the bottom of the boat hull so as to reduce ingression of debris and damage to wildlife.

Reference is now made to FIGS. 19-23 in which a preferred embodiment of the engine housing is discussed. In a preferred embodiment, housing 313 has a convex lower surface 315. In a preferred embodiment, the lower surface of housing 313 is substantially bowl-shaped. In the preferred, but not limiting embodiment, the convex surface is disposed between 1 inch higher than a bottom of the hull 11, or 2 inches lower than the bottom of hull 1. This significantly reduces cavitation in jet drive unit 17.

Figure 22:
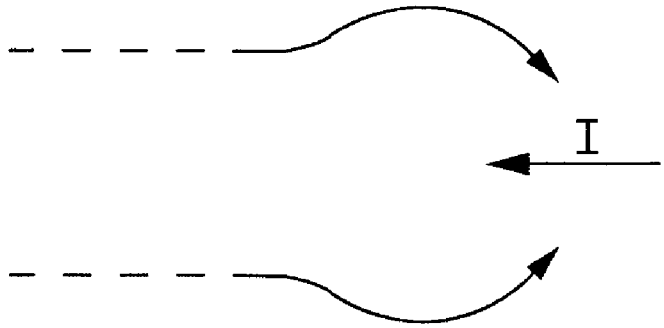
FIG. 22 is a schematic drawing of the water shape as it moves past the housing.
Figure 20:
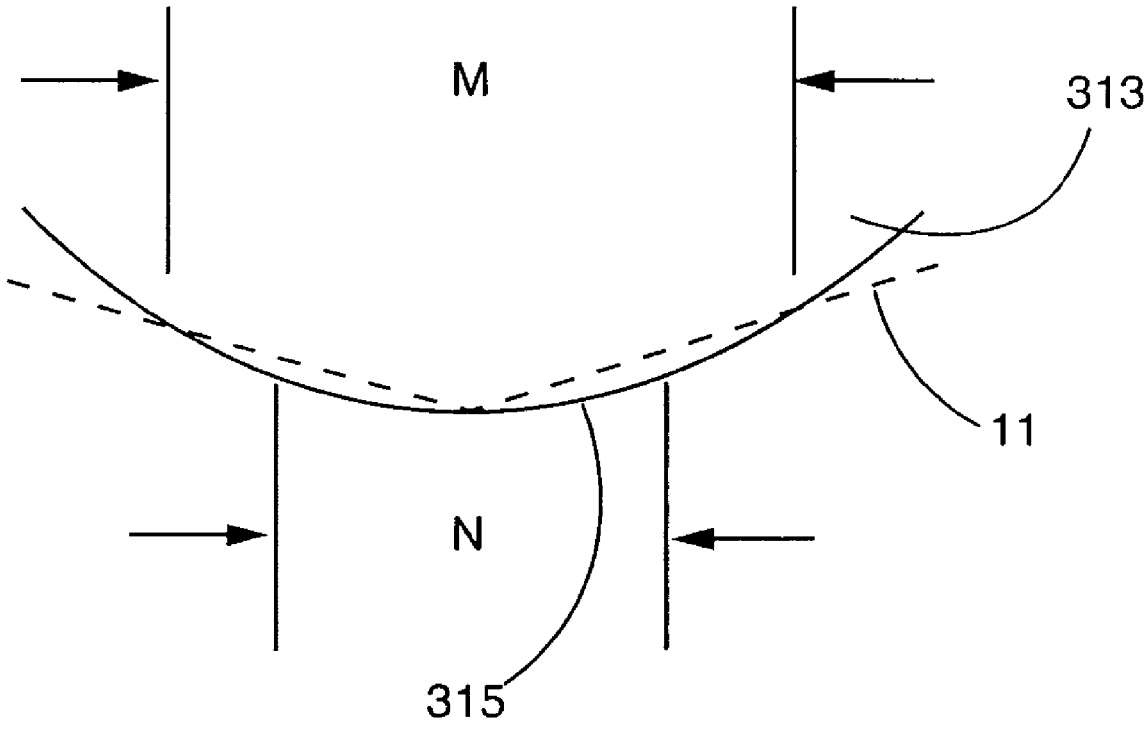
FIG. 20 is a schematic diagram showing the relative widths of the jet inlets and convex portion of the housing.

As hull 11 of a boat passes through the water, air becomes mixed in the water as is noticed in any foaming wake. Air in the water as it passes through jet unit 17 causes cavitation, which reduces the power of outboard propulsion unit 10. However, by providing a rounded, convex lower surface 315 at a trailing position from hull 11, a high-pressure force area is provided along the submerged bottom surface 315 of housing 313. Furthermore, the water assumes a shape, as shown in FIG. 22, as it moves across housing 313. As the water moves relatively in the direction of arrow 1, its path is widened around housing 313 and then narrowed as it travels across housing 313. This is because a high-pressure area is formed along the surface of housing 313 as it moves through the water relative to the surrounding water.

Figure 23:
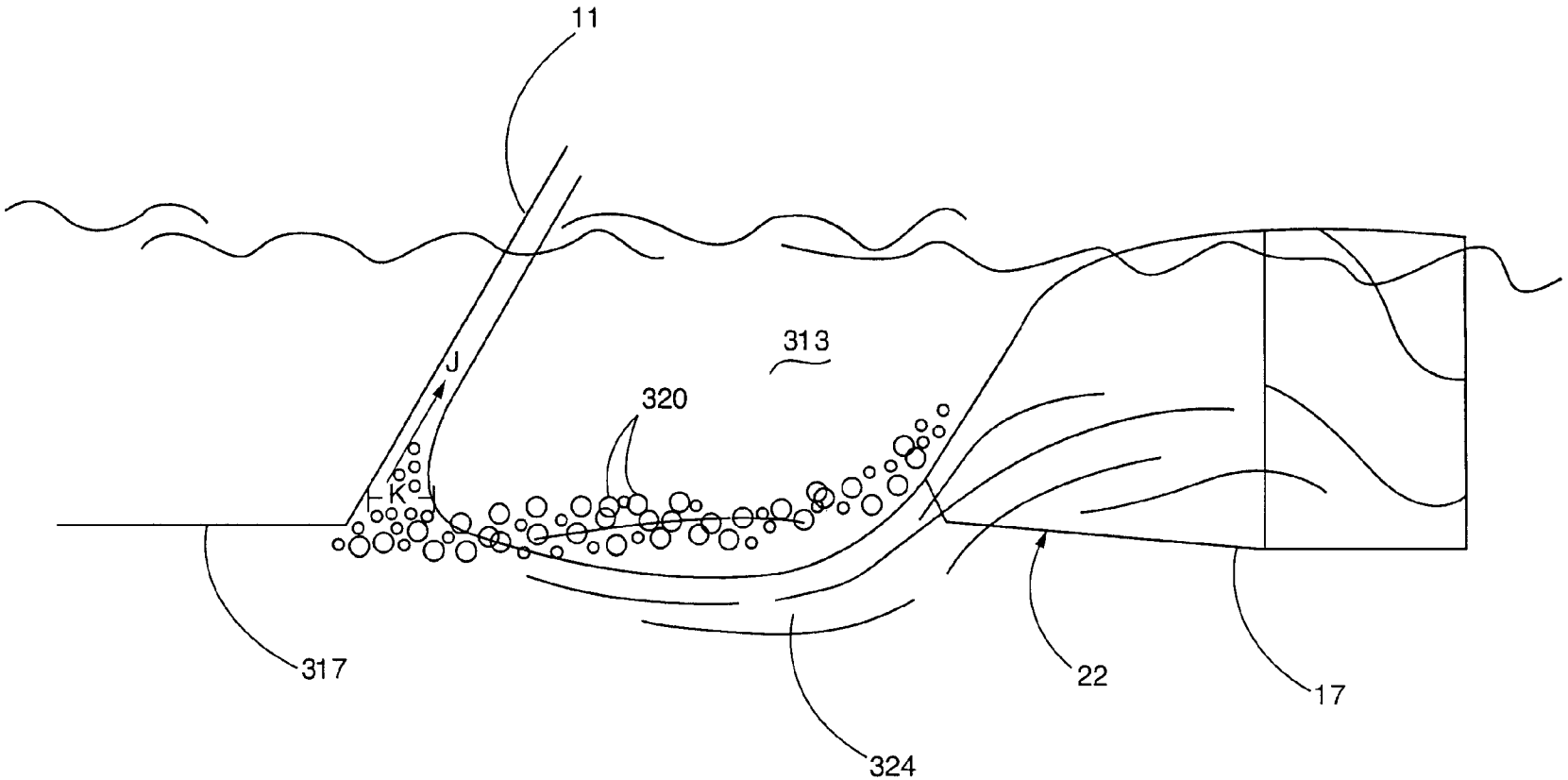
FIG. 23 is a side elevation view of the air and water movement relative to the boat and outboard jet unit.

Because air is less dense and lighter than the water which contains it, it either escapes in the direction of arrow J (FIG. 19) through a low pressure area K located between hull 11 and trailing housing 313 or moves to the sides of housing 313 as shown in FIG. 23. In effect, air bubbles are pushed from the water by the high pressure. Air bubbles 320 seek the low-pressure area at the sides of housing 313, allowing the remaining water to proceed directly to inlet 22. The rounded shape of housing 313 also maintains water close to it in the direction of arrow L more efficiently guiding the water from which the bubbles have escaped towards inlet 22. "Solid" water is what is provided into the inlet, i.e. water from which substantially all air bubbles have been removed, preventing cavitation.

It should be noted that the water traveling in the direction of arrow L tends to travel faster than the water away from housing 313 so that it clings to inlet 22. It also widens in its shape when under pressure as shown in FIG. 22 providing more squeezing of air bubbles out of the desired water stream. As seen in FIG. 23, bubbles 320 seek their own escape as they are squeezed out, allowing a purer stream of water 324 to enter inlet 22 of jet unit 17.

In a preferred embodiment, the width of the convex shape of housing 313 at the width M is greater than a width N of inlet 22. In this way, it is assured that the water 324 flowing towards inlet 22 is at the center of the high-pressure region, further ensuring the removal of the air bubbles 320 from the water. In a preferred embodiment, the width of a convex portion of housing 313 is about 120% the width of inlet 22. Again, bottom surface 315 may be positioned, in a preferred, but non-limiting example, from one inch above a bottom 317 of hull 11 to two inches below bottom 317 of hull 11.

Figure 21A:
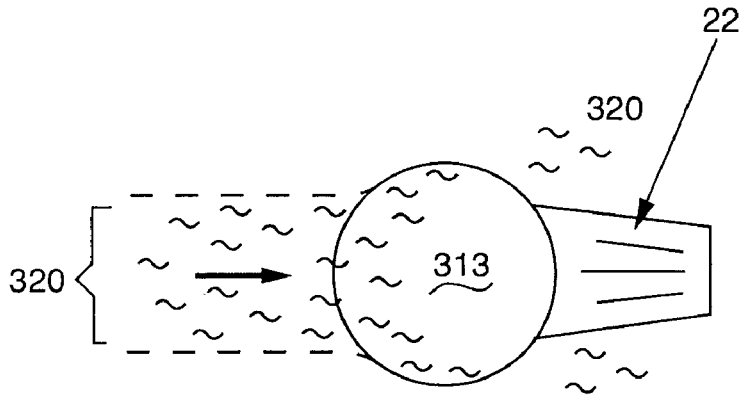
FIGS. 21A-C are schematic drawings of the water and air flow relative to the housing and jet intake.
Figure 21B:
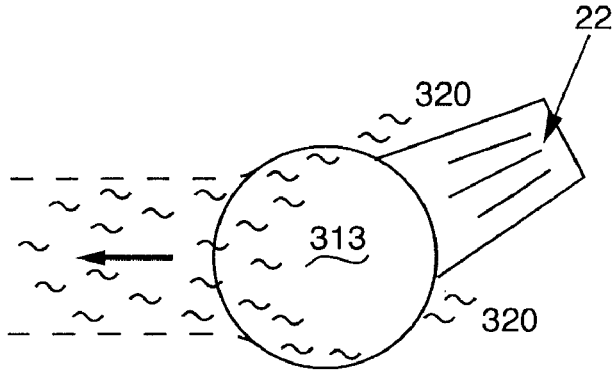
Figure 21C:
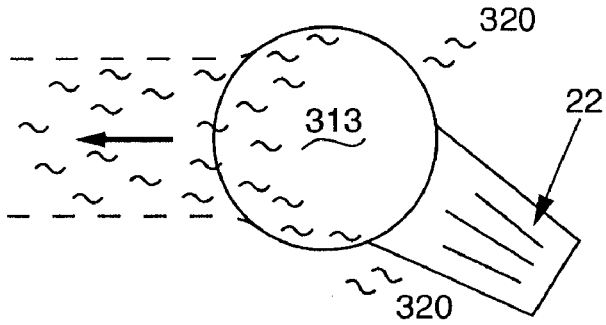

In any event, the width should be sufficient so that the bubbles 320 are diverted sufficiently wide as shown in FIG. 21*a*, they are deflected away from a sufficient radius of intake 22 so as not to interfere or enter inlet 22, whether inlet 22 is in line with hull 11, or during left and right turns (FIG. 21*b*, 21*c*). As can be seen, when bucket assembly 300 is substantially orthogonal with hull 11, the boat is driven forward. When bucket assembly 300 forms an angle of less than 90 degrees (on either side) with hull 11, the boat is turned.

Hull 11 has the main fuel tank 33 mounted therein having a fuel tank inlet 34 and a fuel line 35 extending therefrom through the transom 12 and to a quick disconnect 36 where it can be quickly coupled or decoupled from an internal fuel line 37 located inside the housing 13. The fuel line 37 enters an auxiliary internal fuel tank 38 which has a fuel line 40 connected thereto which is connected to a fuel pump 41 for pumping the fuel from the auxiliary fuel tank 38 and from the main fuel tank 33 and into the fuel line 42 where it is fed directly into the fuel injectors of the engine 16. A fuel return line 43 is connected to the auxiliary fuel tank 38 and to a de-aerator 44 having a bleed top 45 and having a return fuel line 46 from the engine 16 fuel injectors.

A battery 47 is shown mounted within the housing 13 and is connected through a ground line 48 to the jet drive unit 17. The engine and drive unit are controlled through electrical control lines 50 which are connected through a quick electrical connector 51 which is a waterproof connector mounted through the housing 13 and to the engine 16 and clutch unit 27 to control the operation of the outboard jet drive unit.

The rear wall 21 of the housing 13 has a tow bracket 52 attached thereto for attaching a line.

Figure 4:
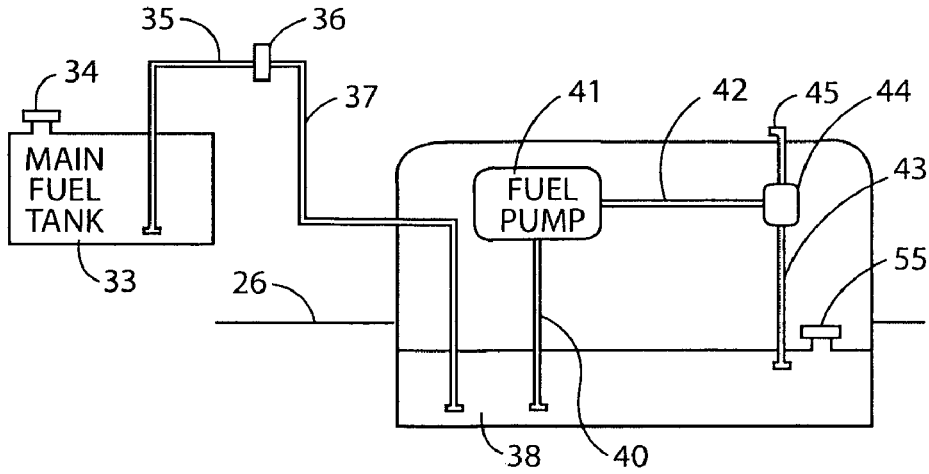
FIG. 4 is a block diagram of the connected fuel tanks.

As seen in FIG. 4, the main fuel tank 33 having the filler cap 34 is connected through the fuel line 35 to the auxiliary tank 38 having an auxiliary tank opening 55 and having the fuel pump 41 connected through the fuel line 40 from the auxiliary tank 38 and through a line 42 to the fuel injectors and back through a de-aerator 44 from the fuel injectors and through the fuel line 43 back to the auxiliary fuel tank 38. A breather 45 is connected to the dc-aerator unit 44.

In operation, the hull 11 has the fuel tank 33 installed therein along with all the controls and sensors. The controls and sensors are connected through the multi-line electrical conductor 50 while the fuel tank is connected through the fuel line 35 through the transom 12. The outboard drive unit 10 can then be attached to the brackets 32 on the transom 12 in a position to align the bottom of the unit with the bottom of the hull 23. In a preferred embodiment, brackets 32 may be shock absorbers to further reduce vibration to engine 16 and jet drive unit 17. Then, merely attaching the quick connect couplings 36 to the fuel line, connects the fuel lines to the outboard jet drive while connecting the quick coupling 51 connects the electrical controls. If the unit has to be removed for any reason, it can be disconnected from the brackets 32 by disconnecting the quick couplings 36 and 51 to remove the entire unit. The outboard jet drive unit 10 is made by constructing a waterproof housing 13 mounting the jet drive unit 17 therein underneath the platform 14 and mounting the engine 16 to the engine mounts 15 on the platform 14 and then connecting the belt drive clutch mechanism 27 between the engine 16 and the jet drive unit 17 through the pulley 28.

Because in a preferred embodiment engine 16 and jet unit 17 ship as a unit, the jet size to use is known. Smaller boats usually forego the reduction and just use a jet, which is too small, operated at engine speed. For those who wish to use a larger jet and a reduction, a transmission must be used. This is an extra cost an extra layer of complexity and an extra gearing change which robs the engine's efficiency. Furthermore, although transmissions could be made to match a particular engine to a particular jet, the current volumes of production make this cost prohibitive.

Another key advantage of the present invention is that the gear ratio can be changed just by changing one or both gears. As a result, any engine power can be matched to a desired RPM in a single jet design. With four or five different jets, a range of engines from 35 HP to 2000 HP can be covered. Thus, one jet can now be used with engines from 50 HP to 400 HP. This is a huge advantage in that different jets do not need to be designed for different engines.

Preferably, housings 13, 201, 206 are sealed mostly to create buoyancy and to protect the engine from corrosion or damage; however, prevention of oil and anti-freeze leaks to the outside (surrounding water) is a side benefit. The leaks from the engine could be isolated by providing a pan below the engine with separate drainage.

Notwithstanding the above, it should be appreciated that, in accordance with the present invention, in certain models, water may enter and exit the heat exchanger and intercooler through holes drilled specifically for that purpose; however, these holes are sealed to prevent water from entering or leaking into the engine compartment. In addition, water may enter into the exhaust ports. However, the engine is far enough above the water line to prevent water from rising high enough to enter the engine or engine compartment. Water also may enter the jet intake and exits the jet nozzle; this water is prevented from entering the engine compartment by sealing the hole around the jet impellor shaft. There may also be air intake vents in the lid in which water may enter. These are made with baffles designed to drain any water, which gets in out through the lid before it gets into the engine compartment.

While the bottom of the housing may be mounted in any suitable position, such as about even with or higher than the bottom of the boat hull, any position around or even with the bottom of the boat is workable. In a preferred position, the bottom of the housing is at about an inch below the bottom of the boat hull on boats to ensure or maximize the amount of clean water that enters the water intake of the jet drive unit. In addition, this position will reduce ingression of debris and damage to wildlife. It of course should be understood that this position may very depending upon the configuration of the bottom of the boat. It is believed that this is the optimum position, because the jet intake is built into the housing. Nevertheless, the bottom center of the boat is the optimum depth position for the water intake in the preferred embodiment.

In a preferred embodiment, marine propulsion unit 10's steering nozzles, exhaust of bucket assembly 300, are generally about 30 inches or more behind boat transom 12. This provides excellent steering leverage and, with a large diameter having water jet 313 moving large amounts of water, it provides crisp steering response and solid tracking with very little correction. The steering control pressures of marine propulsion unit 10 are very light and do not require power steering for comfortable boating.

Because of bucket assembly 300, propulsion unit 10 provides the capability of "putting on the brakes". When propulsion unit 10 is shifted into reverse, all the power of the engine and water jet are applied to stop and reverse the boat. Tests on a 5,000-pound boat equipped with a propulsion unit 10 as described herein show that the boat could be stopped completely within two boat lengths from 30 mph with ease.

The recommended procedure to stop outboard propulsion unit 10 is to reduce the engine RPM by about 50 percent and shift into reverse. If desired, the engine RPM can be increased. In an emergency, the boat can be shifted into reverse directly at any power setting, but that may injure the boat passengers.

Useable space inside a boat is usually at a premium. The outboard propulsion system, in accordance with the invention, and the traditional outboard engines have a distinct advantage over inboard/outboard and inboard systems that require valuable space inside the boat for engines and essential equipment. Even traditional outboards are at a disadvantage compared to the propulsion unit 10 because they generally require space inside the boat when in the tilted up profile. Also, many outboards require a notch in the transom to achieve the correct propeller depth requiring a second "transom" inside the boat to prevent following seas from swamping the boat. That space is lost boat space.

Propulsion unit 10 requires no space inside the boat for any of its components. The increase in space inside the boat is available for any use, e.g., for passengers, bait wells, fish holds, and even for lounging decks.

Because engine 16 is mounted on high quality vibration isolators inside the fiber glass shell and housing 13 is mounted on the boat transom using a second system of vibration isolators, an exceptional and unexpected level of quiet and comfort is provided. As a result, the boat ride is more comfortable and less tiring.

Internal combustion engines get hot when running. That engine heat is handled several ways in a boat. The engine water-cooling system is designed to remove a considerable amount of that heat, but that system operates at about 160 to 220 degrees Fahrenheit to insure that the engine operates correctly. The balance of the heat is released in convection, radiated into the air in the engine compartment. This heat can make it quite uncomfortable in the area of the engine compartment, especially on a hot day. This problem exists with any inboard or UO drive configuration. Ventilating fans and insulation can reduce the problem to a degree, but it is difficult to eliminate.

Outboard marine engines are mounted behind the transom behind the boat. Any heat from these engines that is not carried overboard by the water-cooling system is released into the air behind the boat. This gives all outboard engines a distinct advantage over inboard mounted engines.

Propulsion unit 10 has an added advantage because it has the engine mounted in a sealed box and the air inside the box is normally ingested into the engine and goes out the exhaust in the water. It is very unlikely that a passenger will feel any warming of the air in the boat caused by the propulsion unit.

As a result of sealing housing 313, propulsion unit 10 is uniquely designed with self-buoyant capability. Because the housing is sealed, it provides flotation. Indeed, in a preferred embodiment, at approximately 1 foot of draft, it floats about 250 lbs, at approximately 1.5 foot (18 inches) of draft, it floats about 500 lbs, and at approximately 2 feet of draft, it floats about 850.lbs (approximately the total weight of the marine propulsion system). This is a significant feature and advantage to any boat and especially valuable to smaller boats with low freeboard dimensions.

Some of the new four-cycle outboards are quite heavy and cannot be used on some existing boats because the extra weight causes the scuppers to be submerged. At least one boat manufacturer had to redesign their boat to accommodate these heavy engines. Inboard/outboard and inboard systems depend solely on the boat to provide their flotation. The weight of the propulsion system, in all of these instances, reduces the boats' cargo and passenger carrying capability.

Because of the buoyancy of housing, propulsion unit 10 allows boats to uniquely have more weight carrying capacity and, as a further benefit, more useable space inside the boat is available.

Propulsion unit 10 preferably uses a stainless steel water jet impeller to supply the seawater to the heat exchanger for engine cooling. If the impeller is turning, there is water for the cooling function. Even if the stainless steel impeller were severely damaged, there would be enough water flow to move the boat and provide engine cooling.

What is claimed as new and desired to be protected by Letters Patent of the United States is:

1. An outboard jet drive marine system for a boat comprising:

a housing, said housing having front and rear sides, and a top and bottom, and said housing adapted to be affixed behind a hull of said boat;

an engine disposed within said housing; and a jet drive unit releasably mounted to said housing and extending from the rear of said housing; said jet drive unit including a jet pump, a jet unit housing, a jet exhaust and a drive shaft disposed within and supported by said jet unit housing, said drive shaft extending within said housing and being operatively coupled to said engine within said housing, said jet unit housing being slidably, detachably received by said housing, said jet drive unit defining a straight water path from upstream of said jet pump to said jet exhaust.

2. The outboard jet drive marine system of claim 1, further comprising a drive shaft housing, said drive shaft being disposed within said drive shaft housing, a drive shaft housing support coupling said drive shaft housing to said housing.

3. The outboard jet drive marine system of claim 2, wherein said jet drive unit includes a drive pulley affixed to said drive shaft and operatively coupled to said engine, and a drive shaft housing support member supporting said drive shaft housing at an end of said drive shaft housing adjacent to said drive pulley.

4. The outboard jet drive marine system of claim 3, further comprising a second drive shaft housing support supporting said drive shaft housing substantially at a midpoint of said drive shaft housing.

5. The outboard jet drive marine system of claim 2, Wherein said drive shaft housing support supports said drive shaft housing substantially at a midpoint of said drive shaft housing.

6. The outboard jet drive marine system of claim 5, wherein said drive shaft housing support is disposed between said jet unit housing and said housing.

7. The outboard jet drive marine system of claim 2, wherein said drive shaft housing is detachably received by said housing and said jet unit housing.

8. The outboard jet drive marine system of claim 1, wherein said jet drive unit includes a water exhaust, a bucket assembly mounted on said jet drive unit and being disposed to receive a water jet from said water exhaust, said bucket assembly including a housing, having an entrance port for receiving said water jet, said jet exhaust including a first exhaust and a second exhaust.

9. The outboard jet drive marine system of claim 8, further comprising a bucket member mounted to said bucket housing and movable between a first position in which said first exhaust is closed and a second position in which said first exhaust is open, said bucket causing said water jet to exit through said second exhaust when said bucket is in said first position.

10. The outboard jet drive marine system of claim 9, wherein said second exhaust includes guide members disposed therein for guiding said jet stream toward said boat as said jet stream exits said second exhaust.

11. The outboard jet drive marine system of claim 8, wherein said bucket assembly is rotatably mounted to said jet drive unit so as to selectively move between a first position substantially orthogonal with said hull of said boat and at least a second position in which an angle of less than 90 degrees is formed between said hull of said boat and said bucket housing.

12. The outboard jet drive marine system of claim 1, wherein said bottom surface of said housing has a convex shape.

13. The outboard jet drive marine system of claim 12, wherein said convex shape is substantially bowl shaped.

14. The outboard jet drive marine system of claim 12, wherein said jet drive further comprises a water inlet, said water inlet having a width and said convex shape of said bottom surface having a width, the width of said convex shape being greater than the width of said inlet.

15. The outboard jet drive marine system of claim 12, wherein said hull has a bottom surface, said housing being affixed to said hull so that said bottom surface of said housing is at substantially the same level as the bottom surface of said hull.

16. The outboard jet drive marine system of claim 12, wherein said bottom surface of said housing is disposed between one inch above said bottom of said hull and two inches below said bottom of said hull.

17. The outboard jet drive marine system of claim 1, wherein said engine is substantially oriented in a horizontal direction relative to said housing, and further comprising a cooling system, said cooling system generally being oriented in a vertical orientation relative to said engine.

18. The outboard jet drive marine system of claim 17, wherein said cooling system further comprises a heat exchanger oriented relatively vertically to the engine, and communicating with said jet drive unit to receive a jet of water under pressure from said jet drive unit, said heat exchanger having a bottom surface, said jet of water entering said heat exchanger at the bottom surface.

19. The outboard jet drive marine system of claim 18, further comprising an intercooler, operatively coupled to said heat exchanger to receive water from said heat exchanger and being coupled to fuel and air processed by said engine for heating said fuel and air.

20. The outboard jet drive marine system of claim 18, wherein the heat exchanger is configured to isolate said water jet received by said heat exchanger from said engine.

* * * * *